US007017384B2

(12) United States Patent
Espinosa

(10) Patent No.: US 7,017,384 B2
(45) Date of Patent: Mar. 28, 2006

(54) VEHICLE FRAME STRAIGHTENING JIG

(76) Inventor: Michael Espinosa, 1903 S. Elizabeth, Wichita, KS (US) 67213

( * ) Notice: Subject to any disclaimer, the term of this patent is extended or adjusted under 35 U.S.C. 154(b) by 0 days.

(21) Appl. No.: 10/725,879

(22) Filed: Dec. 2, 2003

(65) Prior Publication Data

US 2005/0115302 A1 Jun. 2, 2005

(51) Int. Cl.
*B21J 13/08* (2006.01)

(52) U.S. Cl. ..... 72/457; 72/447; 72/705

(58) Field of Classification Search ..... 72/305, 72/446, 447, 457, 705
See application file for complete search history.

(56) References Cited

U.S. PATENT DOCUMENTS

| | | | | |
|---|---|---|---|---|
| 2,371,659 | A * | 3/1945 | Stultz | 72/380 |
| 3,141,493 | A | 7/1964 | Textor, Sr. | |
| 3,292,410 | A | 12/1966 | Baldassano | |
| 3,340,720 | A | 9/1967 | Chartier | |
| 3,691,817 | A | 9/1972 | Friend et al. | |
| 3,921,433 | A | 11/1975 | Whitney | |
| 4,289,016 | A | 9/1981 | Hare | |
| 4,519,236 | A | 5/1985 | Celette | |
| 4,530,232 | A * | 7/1985 | Smith | 72/447 |
| 4,549,423 | A * | 10/1985 | Masui | 72/295 |
| 4,603,570 | A * | 8/1986 | Dehn | 72/305 |
| 4,660,405 | A * | 4/1987 | Widegren et al. | 72/447 |
| 4,791,802 | A * | 12/1988 | Celette | 72/447 |
| RE32,926 | E | 5/1989 | Colby | |
| 5,014,538 | A | 5/1991 | Eltvik | |
| 5,016,465 | A | 5/1991 | Papesh | |
| 5,031,438 | A | 7/1991 | Flannery | |
| 5,054,307 | A | 10/1991 | Wisner | |
| 5,186,039 | A | 2/1993 | Celette | |
| 5,634,368 | A | 6/1997 | Venalainen | |
| 5,644,946 | A | 7/1997 | Weschler | |
| 5,819,576 | A | 10/1998 | Smith, Jr. | |
| 5,910,186 | A | 6/1999 | Weschler | |
| 6,182,493 | B1 | 2/2001 | Weschler | |
| 6,216,524 | B1 | 4/2001 | Weschler | |
| 6,269,676 | B1 | 8/2001 | Soyk | |
| 6,347,457 | B1 | 2/2002 | Espinoza et al. | |
| 6,389,703 | B1 | 5/2002 | Ferenczi | |
| 6,484,554 | B1 | 11/2002 | Soyk | |
| 6,568,237 | B1 | 5/2003 | Graham et al. | |

* cited by examiner

*Primary Examiner*—Ed Tolan
(74) *Attorney, Agent, or Firm*—Shughart Thomson & Kilroy; Marcia J. Rodgers

(57) ABSTRACT

A vehicle frame and unibody straightening jig has eight joints, each including a socket for connecting a pulling tower assembly. A spider joint at one end of the jig includes five spaced sockets radiating within a 180° arc. Multiple pulling towers can be installed side-by-side on the same side of a vehicle. The jig also includes lateral support legs or outriggers pivotable about a 90° arc and foldable against the spine to reduce the width of the jig for storage. Clamps are mounted on the outriggers for connecting the jig to a vehicle frame or unibody, The clamps are adjustable along the length of the legs to permit connection of the jig with a wide variety of vehicle frames and unibody structures. The jig also includes a carriage assembly with wheels for easy positioning beneath a vehicle.

23 Claims, 4 Drawing Sheets

VEHICLE FRAME STRAIGHTENING JIG

BACKGROUND OF THE INVENTION

The present invention is broadly concerned with a jig for straightening a metal vehicle frame or body. More particularly, it is concerned with a portable folding jig used in connection with a plurality of pulling towers for simultaneously exerting pulling forces on a vehicle from multiple directions, several pulling towers being positionable on the same side of a vehicle.

Serious collision damage to vehicles such as cars, trucks and sport utility vehicles generally includes misalignment of the frame or unibody structure. The nature and extent of such misalignment may be determined using a centerline gauge to read and record a series of measurements, which are then compared with manufacturers' published vehicle dimension specifications. This enables determination of the severity of under-body damage and mapping of its various locations. The frame damage is then repaired by attaching a pulling tower or power post assembly to a point on a vehicle frame or unibody structure and actuating a hydraulic ram to pull the deformed portion of the frame and body into alignment. By performing a series of pulls, the chassis including the frame or unibody may be returned to its proper dimensions and alignment.

Large, bench-type frame machines may be employed to secure the vehicle during this procedure. These machines typically include a drive-on supporting platform or table with a series of apertures spaced around the perimeter for attachment of a pulling chain which is actuated by a pulling tower. The vehicle is supported above the table by clamps to the pinch weld of a unibody, and the chains are hooked to the damaged sections. Fixed beams are coupled with the table, and are capable of mounting multiple pulling devices. These bench-type machines are powerful and effective, and they permit a full range of movement of the pulling devices to any position around the vehicle. The pulling towers can be positioned side-by-side, on one side of the table for straightening side damage to the vehicle. But these machines are expensive to purchase as well as to operate, since technicians must be trained in their use. They take up a full bay in a body shop and are too heavy and cumbersome to be moved about when not in use.

Floor mounted platform systems have been developed which provide a somewhat cheaper alternative. In these systems, the platform is bolted to the shop floor and so-called "floor pots" are cemented into the floor at preselected locations for coupling with the pulling towers. These systems do not stand as high as the larger frame machines because they do not include structure for lifting the vehicle. They are large, however, taking up a full bay, and they require permanent installation.

Alternatively, an individual post-type pulling device can be chained between a floor pot and the vehicle and actuated to pull one damaged section of a vehicle at a time while the vehicle remains on the floor. Such portable towers are well-suited to exert pulling force along the longitudinal axis of the vehicle. However, in order to provide a range of pulls, they must be moved about the vehicle. They are not well configured to perform side pulls, since multiple devices cannot be positioned on one side of a vehicle, and they do not make lower pulls with the power of the larger machines. Mechanics dislike working with such devices on the floor, as access to the underside of the vehicle is limited and inconvenient.

In recent years there have been attempts to develop portable frame machines or jigs that permit attachment of pulling towers to a portable base. Such jigs permit simultaneous attachment of more than one pulling tower, like the big machines, but the towers have a limited range of motion. In order to provide a range of pulls, the base and towers must be disengaged and repositioned. Such machines also do not permit attachment of the towers adjacent each other on one side of the vehicle, for example, to perform a side pull using multiple towers. A particular advantage of such portable frames is that they can be stowed in a convenient location when not in use.

There is still a need for an economical, portable jig that provides the complete range of pulls as well as simultaneous pulls from the same side of a vehicle that have previously been available only with large platform collision repair systems.

SUMMARY OF THE INVENTION

The present invention provides a greatly improved vehicle frame and body straightening jig which is portable for easy positioning beneath a vehicle and connection with the frame or unibody structure, and which provides up to eight joints radiating from a central axis for attachment of pulling tower assemblies to provide a range of pulls not previously available with portable devices. The jig can also support multiple pulling towers on the same side of a vehicle without the need for additional anchoring. It is adjustable to enable coupling with a variety of types of vehicles. The jig is relatively light weight and is easily movable when supporting a vehicle.

The jig includes an elongated central spine with a spider joint at one end, an end joint at the opposite end, and a pair of center joints. Each of the joints includes a receiver or socket for connecting a pulling tower assembly. The spider joint includes a plurality of angularly oriented receivers, for example, five receivers in a fixed radiating arrangement within a 180° arc. The jig also includes a series of laterally extending support legs or outriggers that may each be pivoted about a 90° arc from the spine and may also be folded flat against the spine to reduce the width of the jig for storage. Clamps are mounted on the outriggers for connecting the jig to a vehicle frame or unibody. The clamps are adjustable along the length of the legs to permit connection of the jig with a wide variety of vehicle frames and unibody structures. The jig also includes a carriage assembly with wheels. The end joint is adapted to receive a detachable handle for steering the jig when it is rolled.

Objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figures 1, 2:
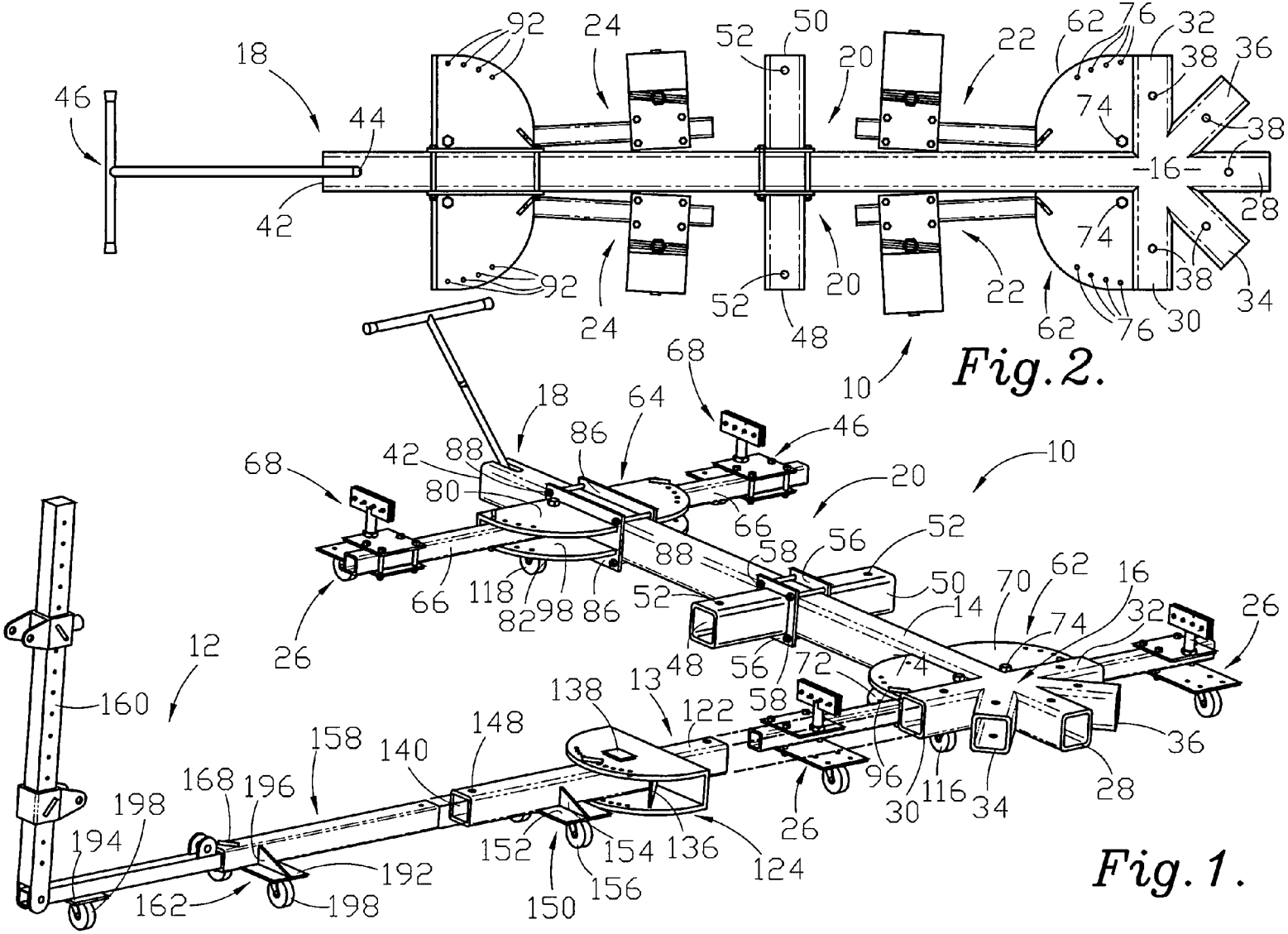
FIG. 1 is a perspective view of a frame straightening jig apparatus in accordance with the present invention.
FIG. 2 is a top plan view of the jig depicted in FIG. 1 in a folded configuration suitable for stowing.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring now to the drawing figures, the reference numeral 10 refers to a vehicle frame and body straightening jig apparatus in accordance with the invention, which is depicted in FIGS. 1, 3, 6, 7 and 8 in association with one or more pulling assemblies or towers 12 which are connected thereto by swivel attachments 13. The jig 10 includes a base or spine member 14 having a spider joint 16 at one end, an end joint 18 at the opposite end, and at least one central or intermediate joint 20 therebetween. The apparatus 10 also includes a pair of forward outrigger assemblies 22 and a pair of aft outrigger assemblies 24, each including a carriage assembly 26.

Figures 3, 4:
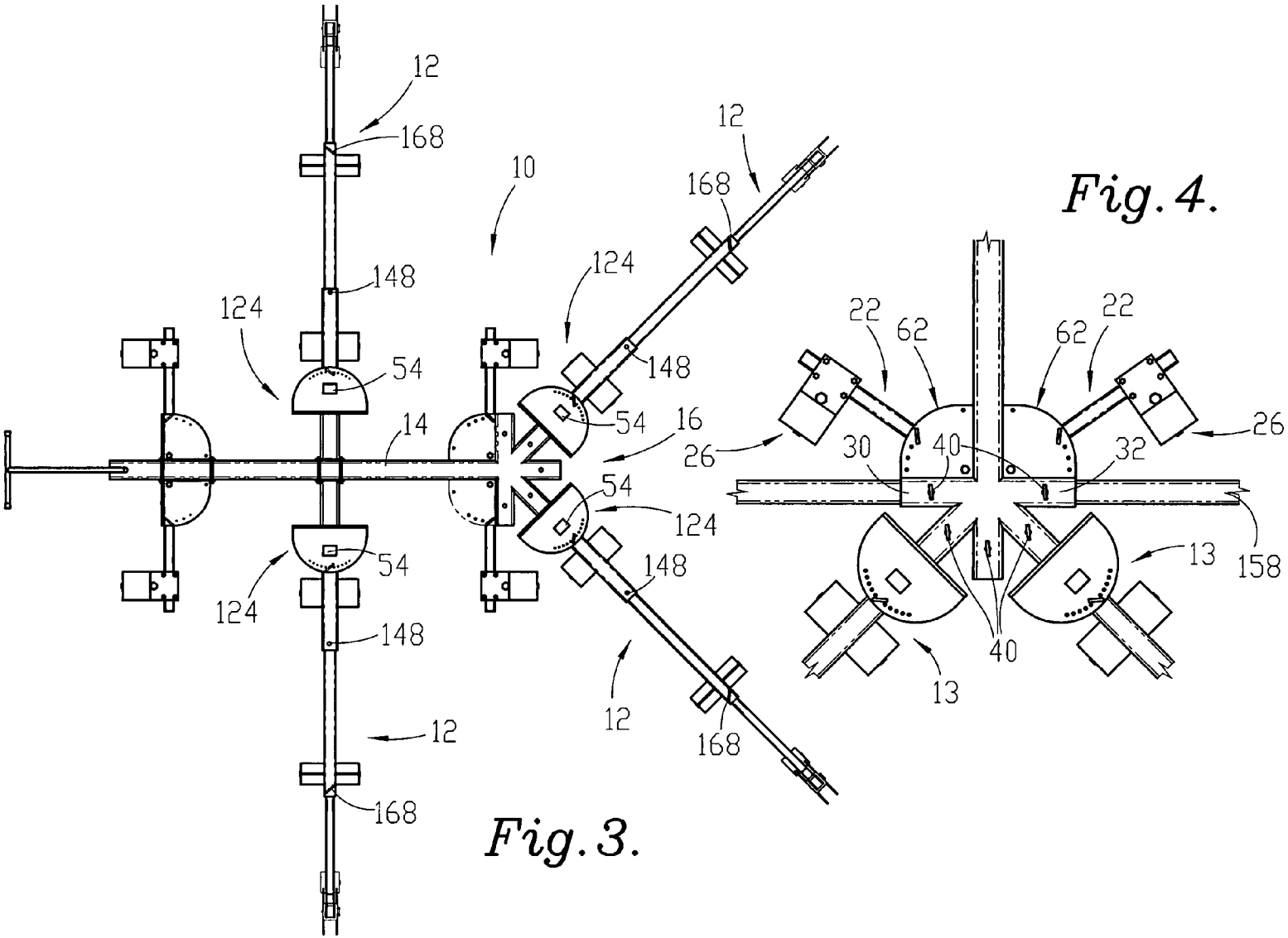
FIG. 3 is a top plan view of the of the jig at a reduced scale and showing four pulling devices attached to the jig.
FIG. 4 is a top plan view of the joint section of the jig at a somewhat enlarged scale with parts of four pulling devices installed in the spider joint.

In more detail, the spine 14 is a fairly narrow, elongated structure. A first end terminates in the spider joint 16, having five angularly spaced sockets or receivers including a central socket 28 aligned or coaxial with the spine 14, a pair of orthogonal lateral sockets 30 and 32 and a pair of diagonal sockets 34 and 36 therebetween. The five sockets or receivers 28, 30, 32, 34 and 36 radiate at 45° intervals within a 180° arc. Each of the sockets includes an aperture 38 for receiving a pin 40 (FIG. 4).

Figure 6:
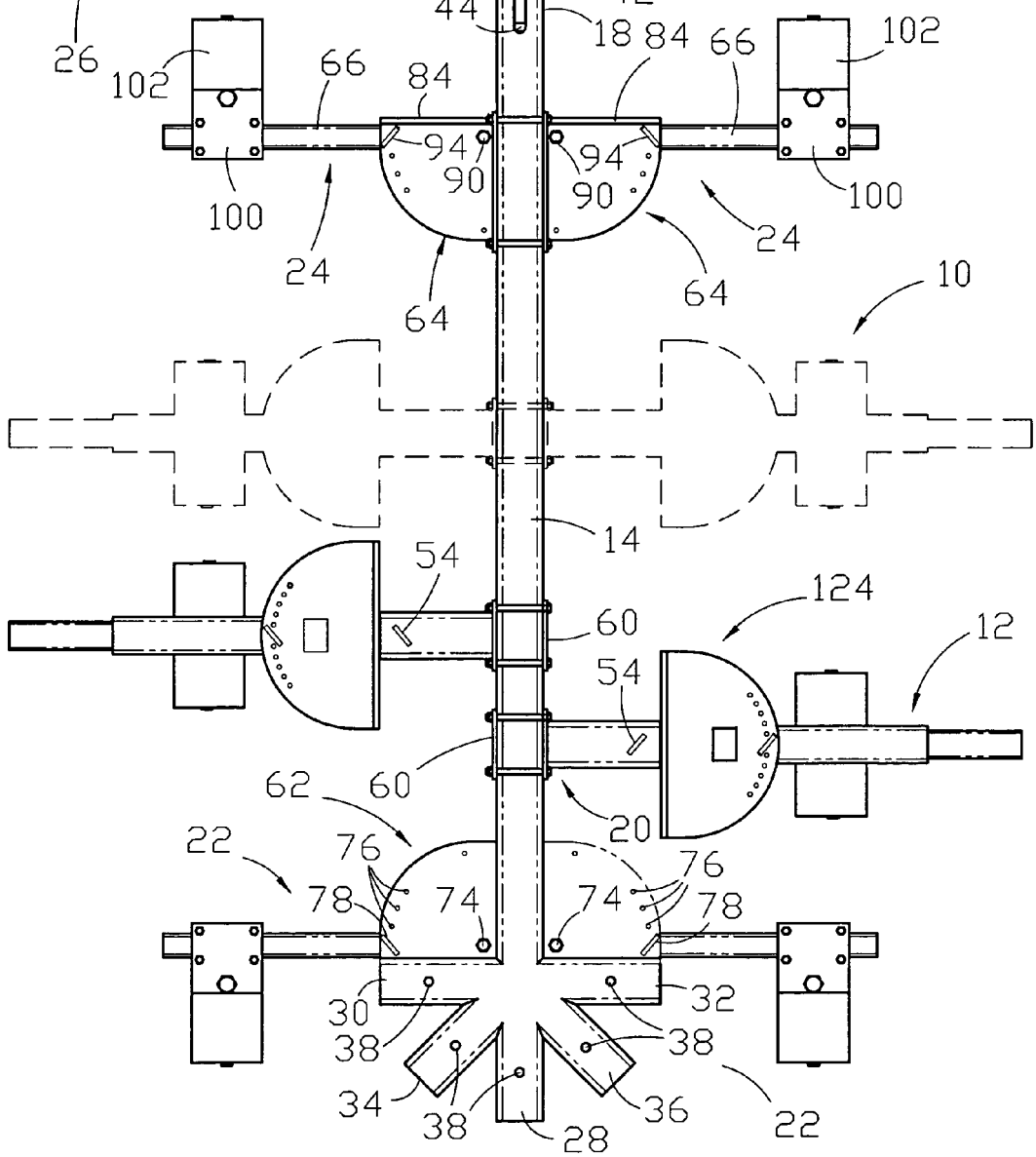
FIG. 6 is a view similar to FIG. 2 with the center socket shown in a longitudinally displaced position.

The second end of the spine 14 terminates in the end joint 18. The joint 18 includes a receiver or socket 42 having an aperture 44 for receiving an optional handle 46 or a pin (not shown). A midportion of the spine 14 includes a central or intermediate joint 20 having a pair of receivers or sockets 48 and 50 which may be in opposed or staggered relation on either side of the spine 14 or on the same side of the spine (FIG. 6). The outstanding lateral end of each socket 48 and 50 includes an aperture 52 for receiving a pin 54. A spine-contacting portion of each socket 48 and 50 includes an orthogonally expanded foot 56 (FIG. 1). The length and width of the foot 56 exceed the diameter of the spine 14. The perimeter of the foot 56 is apertured, so that the pair of sockets 48 and 50, can be aligned in opposed relation on either side of the spine 14 and connected by means of bolts 58 straddling the upper and lower surfaces of the spine 14. Where it is desirable to stagger or offset the sockets 48 and 50 at different locations along the length of the spine 14, a pair of apertured plates 60 is employed to receive the bolts 58 from the sockets 48 and 50 (FIG. 6).

The forward and aft pairs of outrigger assemblies 22 and 24 include respective pairs of generally quadrant-shaped pivot assemblies 62 and 64. Each outrigger assembly 22 and 24 also includes a support leg 66 and a vehicle connector assembly 68.

The forward pivot assemblies 62 each include a pair of planar, quadrant-shaped upper and lower pivot or sector plates 70 and 72 welded in horizontal, spaced, parallel relation at the perpendicular junction of the spider joint 16 with the spine 14. Each pair of pivot plates 70 and 72 is apertured adjacent the junction for receiving a pivot bolt 74. The curvate perimeter of each of the pivot plates 70 and 72 includes a series of spaced apertures 76 for receiving pins 78 (FIG. 6) to fix the support members 66 in place.

The rear pivot assemblies 64 each include a similar pair of planar, quadrant-shaped upper and lower pivot or sector plates 80 and 82. Rearward-facing margins or radii of the pivot plates 80 and 82 are interconnected by a rear sidewall 84 (FIG. 6) which serves as a stop against 180° rotation of the support legs 66 to a rearward projecting position adjacent the spine 14. The center-facing margins or radii are interconnected by a center sidewall 86 having vertical dimensions which slightly exceed the diameter of the spine 14. The perimeter of the sidewalls 86 are apertured so that so that a pair of rear pivot assembly sidewalls 86 can be aligned in opposed relation on either side of the spine 14 and connected using fasteners such as bolts 88 straddling the spine 14. Alternatively, the center sidewalls 86 can be constructed in the same manner as the rear sidewalls 84, and the center sidewalls 86 fastened in place on the spine 14 by welding. Like the forward pivot assemblies 62, each pair of pivot plates 80 and 82 of the rear pivot assemblies 64 is apertured adjacent the junction for receiving a pivot bolt 90. The curvate perimeter of each of the plates 80 and 82 also includes a series of spaced apertures 92 for receiving pins 94 (FIG. 6). Those skilled in the art will appreciate that the pivot plates 70, 72, 80 and 82 need not be quadrant or sector shaped. It is foreseen that the pairs of upper pivot plates 70 and 80 may each be joined to form a single, generally semi-circular respective forward or rear upper pivot plate and that the pairs of lower pivot plates 72 and 82 may be similarly joined. The center sidewall 86 is preferably omitted from the rear plates 80 and 82. Such semi-circular upper and lower plates 70 and 72 and 80 and 82 are fastened to the upper and lower surfaces of the spine 14 by means of welding or fasteners.

In both forward and rear pivot assemblies 62 and 64, the space between the parallel pivot plates 70 and 72 and 80 and 82 forms a slot 96 or 98 sized for receiving a support leg 66. The support legs 66 are of tubular steel construction, and each is apertured through at one end to receive a pin 78 or 94 for pivotal connection with a respective pivot assembly 62 or 64.

Figure 5:
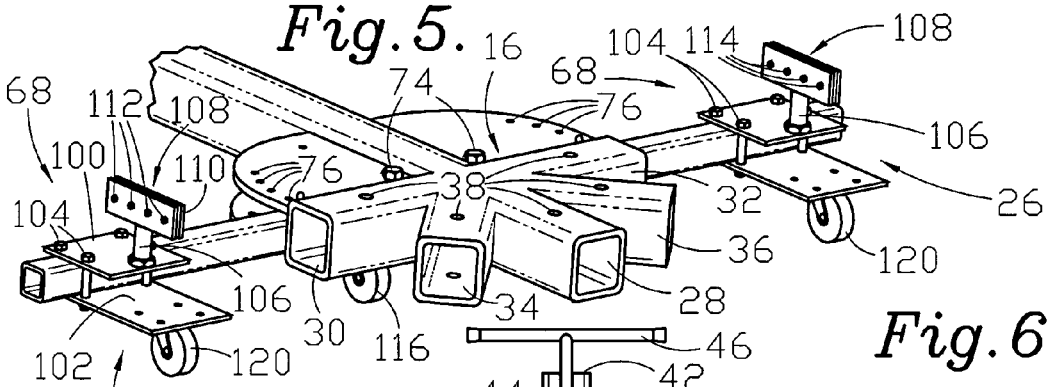
FIG. 5 is a fragmentary perspective view at an enlarged scale and shows the outriggers, carriage assemblies and pinch weld clamps.

A vehicle connector assembly 68 is attached to the outer end of each support leg 66. Each connector assembly 68 includes a generally planar top support plate 100 and bottom support plate 102 (FIG. 5). The top plate 100 is approximately square, while the bottom plate 102 is somewhat elongated. The plates are sized to exceed the dimensions of the legs 66 and are correspondingly apertured to receive bolts 104, which straddle the sides of the legs 66 to connect the support plates 100 and 102. The upper support plate 100 supports an upstanding stem 106 (FIG. 6). A pinch weld clamp or grip 108 is vertically adjustably mounted on the stem 106, and includes a pair of elongate clamping plates 110 and 112. The plates are adjustably interconnected by bolts 114. The clamp 108 is adapted to grip a peripheral pinch weld typically employed in unibody constructions to connect a lower section and a side section of sheet metal.

Those skilled in the art will appreciate that, where the vehicle to be repaired is of body-over-frame construction, adaptors suitable for attachment to a section of the frame may be substituted for the clamps 112.

The jig 10 is movably supported on a carriage assembly 26, which includes a pair of front casters 116 (FIG. 1) secured by welding or other suitable means to the lower surfaces of the lateral sockets 30 and 32 of the spider joint 16. The carriage assembly 26 also includes a pair of rear casters 118, similarly secured to the lower surfaces of the lower pivot plates 82 of the rear pivot assemblies 64. An outrigger caster 120 (FIG. 5) is also secured to the lower surface of the portion of the elongate bottom support plates 102 that extends beyond the top support plates 100 of the connector assemblies 68 of the support legs 66.

Figures 7, 8:
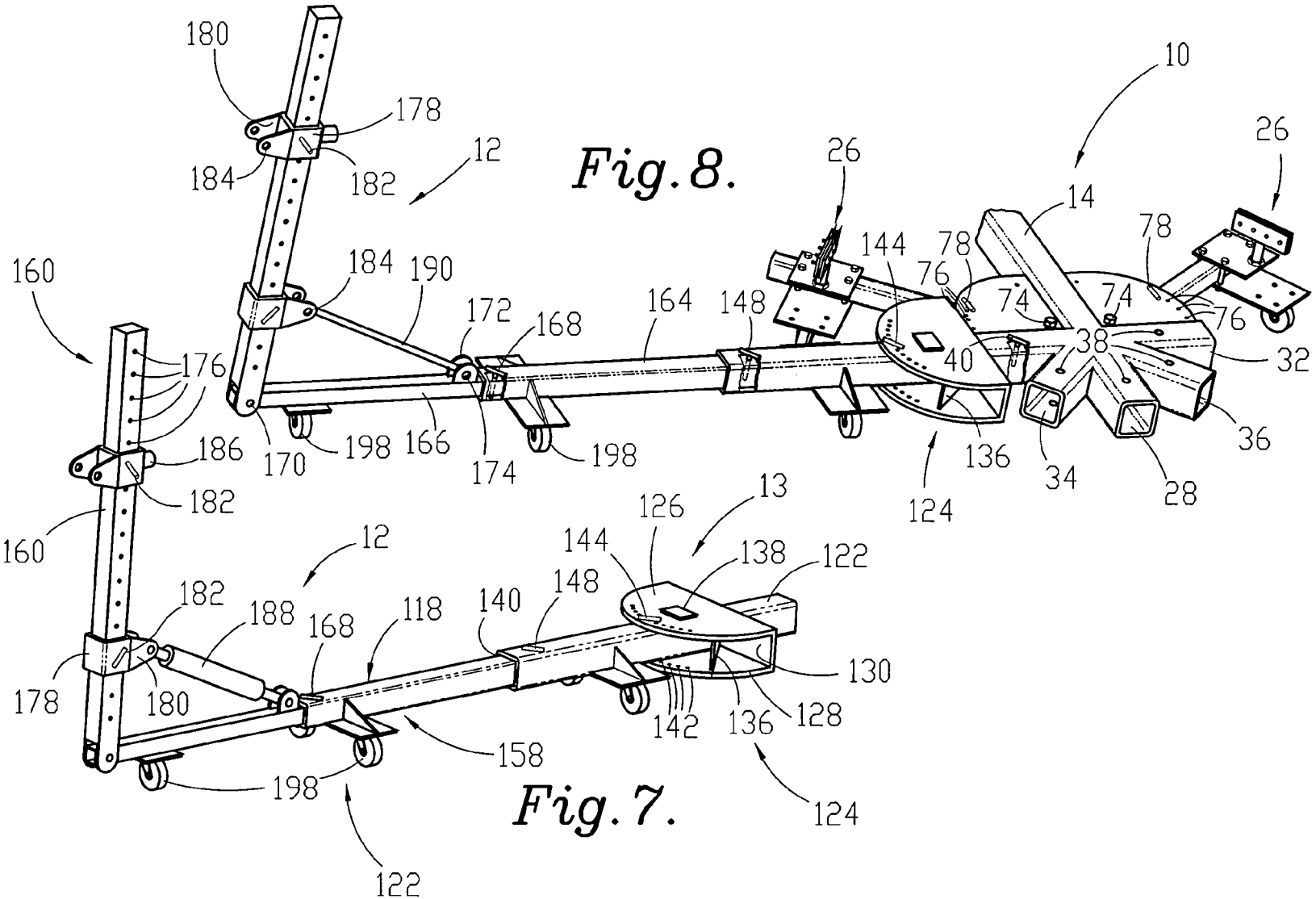
FIG. 7 is a perspective view of a pulling tower assembly installed in a swivel attachment for use in conjunction with the jig.
FIG. 8 is a fragmentary perspective view of the spider joint of the jig showing a swivel attachment intercoupling an attached pulling tower assembly to one socket of the joint.

The frame straightening jig 10 of the present invention is designed for use in conjunction with a plurality of conventional pulling assemblies or towers 12, best shown in FIGS. 1, 7 and 8, each interconnected to the jig 10 by a swivel assembly or attachment 13. The swivel attachments 13 each include a leg 122 sized for reception in one of the jig sockets 28, 30, 32, 34, 36, 42, 48 or 50 and coupled with a pivot joint 124. The pivot joint 124 includes a pair of semicircular upper and lower pivot or sector plates 126 and 128 connected by a rear sidewall 130 along the diameter or straight margin. It is foreseen that the pivot plates 126 and 128 may be constructed in other shapes, such as, for example, the generally elongated shape depicted in U.S. Pat. No. 6,216,524 B1. A space or slot 132 between the pivot plates 126 and 128 is subdivided by a pair of diagonal sidewalls or stops 134 and 136. The pivot plates 126 and 128 are centrally apertured to receive a pivot or link pin 138 for connecting a socket member 140. The perimeter of the plates 126 and 128 include a series of sets of vertically aligned spaced apertures 142 for receiving a pin 144 for holding the socket 140 at a predetermined angular orientation. The outer end of the socket member 140 is also apertured for receiving a pin 148. A carriage assembly 150 includes an elongate support plate 152 having on its upper surface a pair of upstanding right triangular supports or gussets 154 providing bracing for rigidity, and on its lower surface, a pair of ground-engaging casters 156.

Each pulling tower assembly 12 includes a telescoping section or tongue 158 pivotally connected to an upstanding post section or tower 160 and an outer carriage assembly 162.

The tongue 158 includes a first segment or section 164 (FIG. 8) that is inwardly extending during normal use, and an outer second segment or section 166. The sections 164 and 166 are vertically apertured at each end and are held in place in telescoping relation by pins 168, except that the outer end of the second section 166 is horizontally apertured for pivotal connection with the tower section 160 by a pivot pin 170. An inward end of the second section 166 includes a pair of upstanding ears 172, equipped with a pair of horizontally aligned apertures 174.

The sides of the upstanding tower post or section 160 include a series of aligned, vertically spaced horizontal apertures 176 and a pair of brackets 178 which wrap around the tower post 160 and terminate in a forwardly projecting pair of ears 180. The brackets 178 are horizontally apertured to receive pins 182 for holding the them in aligned placement with a preselected horizontal aperture 176. The ears 180 also include apertures 184. The uppermost bracket 178 is mounted with the ears 180 projecting outwardly, and the inward facing surface of the bracket 178 includes a boss 186. As shown in FIG. 7, the ears 172 and 180 are coupled with the ends of a cylinder 188, which is actuated by a hydraulic or compressed air system (not shown). Alternatively, FIG. 8 depicts the ears 172 and 180 coupled with a rigid link 190 as may be employed when the tower assembly 12 is employed as a fixed position anchor.

The pulling tower carriage assembly 162 includes first and second support plates 192 and 194 (FIG. 1) mounted below respective first and second sections 164 and 166. The first support plate 192 is elongate, including on its upper surface a pair of upstanding right triangular supports or gussets 196 for preventing lateral movement of the first section 164 on the plate 192. The second support plate 194 is generally square shaped. The lower surfaces of each support plate 192 and 194 include a pair of ground-engaging casters 198.

The jig 10 is preferably formed of square tubular steel construction, although round tubular steel or solid bars may also be employed. Those skilled in the art will appreciate that, while the drawing figures depict a jig 10 having eight socket receivers with a five socket spider joint 16 at one end and an end joint 18 having one receiver 42, the end joint 18 may also be constructed to include a spider joint so that the jig may include 12 sockets. It is also foreseen that the intermediate joint 20 may include more than two sockets 48 and 50, so that the jig may include as many as 14 or more sockets.

In use, a mechanic or technician employs a jack to raise one end of a vehicle such as a car, truck or the like. The jig 10, in normal storage configuration with the outriggers 22 and 24 folded against the spine 14, is easily rolled into place below the vehicle by guiding the carriage assembly 26 using the optional handle 46. The mechanic positions the jig 10 so that the spine 14 is aligned with the longitudinal axis of the vehicle, with the spider joint 16 at one end and the end joint 18 at the other. If the end socket 42 is to be used, the handle 46 is removed. The outriggers 22 and 24 are unfolded from the spine 14 and extended laterally, and the connector assemblies 68 are adjusted along the length of the legs 66 as may be needed to connect the pinch weld or jack tabs between the clamping plates 110 and 112. If necessary, one or more outriggers may also be rotated slightly to achieve alignment of the connector assemblies 68 with the pinch weld. The clamp 108 is then tightened in place over the pinch weld. Depending on the pattern of the collision damage and the necessary pulls, it may be desirable to first remove one of the wheels in order to facilitate placement of an outrigger 22 or 24. The clamped end of the vehicle is then lowered, and the process is repeated at the opposite end. In this manner, the jig 10 is connected through the outriggers 22 and 24 to the vehicle by two pairs of clamps 108 on each side of the vehicle, each pair of clamps 108 being in approximately opposed relation.

The mechanic next connects a pulling tower assembly 12 to a swivel attachment 13 by inserting the end of the tongue 158 into the socket 140, aligning the apertures and inserting a pin 168. The swivel attachment leg 122 is inserted into a socket of the jig 10, for example the lateral socket 30. The pin 144 of the swivel attachment socket member 140 may be removed and the socket member 140 rotated in the pivot joint 124 to a desired position and the pin 144 replaced to secure the angular attitude of the attachment 13. One end of a chain (not shown) is then coupled with the upper tower bracket 178 and the other end attached to a point on the vehicle to be pulled.

The process may be repeated to install a second pulling tower assembly 12 in the intermediate socket 48, for example, to permit a simultaneous pull using side-by-side pulling assemblies 12. The hydraulic cylinders 188 are next actuated to perform the pull. It is foreseen that a hydraulic cylinder may be coupled with the boss 186 of the upper bracket 178, and that a pulling tower assembly 12 may be employed to push against the vehicle rather than pull. It is also foreseen that any or all of the five sockets 28, 30, 32, 34 and 46 of the spider joint 16 as well as the two sockets 48 and 50 of the intermediate joint, and the end socket 42 may be equipped with pulling tower assemblies 12 for simultaneous side-by-side, diagonal, or opposed pulling, pushing, or any combination thereof. Where the vehicle is of body-over-frame construction, the connector assemblies 68 may be equipped with adaptors to receive a frame member. Once initial frame straightening pulls are made measurements can be made to determine if desired alignment of the frame has been achieved. IF not, adjustments in the positions of the tower 12 can be made and the process repeated until the frame alignment has been restored.

The jig may also be used as a dolly, to move the vehicle about on the floor of the shop. When the pulling operations have been completed, the installation process is reversed, including replacement of any wheels that have been removed. The jig 10 is then folded to its storage position by rotating the forward and aft outriggers 22 and 24 to a position adjacent the spine 14. In this manner, the width of the jig 10 is substantially reduced so that it can be stored out of the way.

It is to be understood that while certain forms of the present invention have been illustrated and described herein, it is not to be limited to the specific forms or arrangement of parts described and shown.

What is claimed and desired to be secured by Letters Patent is as follows:

1. A vehicle frame and body straightening jig comprising:
(a) an elongated longitudinal spine member having opposite ends;
(b) a plurality of support legs extending from said spine member to support said jig on a support surface;
(c) a frame connection device positioned on at least one of said legs to connect said jig to a vehicle frame; and
(d) a spider joint positioned at an end of said spine member, said spider joint including a plurality of receivers, each receiver adapted to enable selective connection of a pulling assembly to said receiver, said receivers being fixed in a selected radiating relation.

2. A jig as set forth in claim 1, including:
(a) a carriage assembly having ground engaging wheels.

3. A jig as set forth in claim 2, wherein said carriage assembly further includes:
(a) ground engaging casters connected to each of said ends of said spine member.

4. A jig as set forth in claim 1, including:
(a) a handle positioned at an end of said spine member.

5. A jig as set forth in claim 1, wherein:
(a) said support legs are pivotally coupled with said spine member to enable selective angular adjustment of said legs on said support surface and selective positioning of said legs to connect to a vehicle frame or body to be straightened.

6. A jig as set forth in claim 1, wherein:
(a) said support legs are pivotable to a folded position generally parallel and adjacent to said spine member.

7. A jig as set forth in claim 1, including:
(a) pivot plates connecting said support legs to said spine to enable pivoting and fixing said legs in a selected angular orientation with respect to said spine member.

8. A jig as set forth in claim 1, including:
(a) said frame connection device being adjustably connected with said leg for connecting said jig to a variety of vehicle frames.

9. A jig as set forth in claim 1, including:
(a) a center joint translatable along said spine, said center joint including a pair of receivers, each receiver adapted to enable connection of a pulling assembly to said receiver.

10. A jig as set forth in claim 1, including:
(a) a pair of center joints, each independently translatable along said spine, said joints each including a receiver adapted to enable connection of a pulling assembly to said receiver.

11. A jig as set forth in claim 1, wherein:
(a) said spider joint is positioned at one of said ends of said spine member; and
(b) a receiver positioned at another of said ends of said spine, member, said receiver adapted to enable connection of a pulling assembly to said receiver.

12. A jig as set forth in claim 1, wherein:
(a) said pulling assemblies are hydraulically actuated.

13. A vehicle frame and body straightening jig comprising:
(a) an elongated longitudinal spine member having opposite ends;
(b) a plurality of support legs extending from said spine member to support said jig on a support surface;
(c) a frame connection device positioned on at least one of said legs to connect said jig to a vehicle frame;
(d) a spider joint positioned at an end of said spine member, said spider joint including a plurality of receivers, each receiver adapted to enable selective connection of a pulling assembly to said receiver, said receivers being fixed in a selected radiating relation; and (e) said spider joint including five evenly spaced joints radiating within an arc of 180°.

14. A vehicle straightening jig comprising:
(a) an elongated longitudinal spine member having opposite ends;
(b) a plurality of support legs extending from said spine member to support said jig on a support surface;
(c) a frame connection device positioned on at least one of said legs to connect said jig to a vehicle frame; and
(d) a joint positioned on said spine member, said joint including a plurality of receivers to enable selective reception of at least two pulling assemblies on one side of the vehicle, each receiver adapted to enable connection of a pulling assembly to said receiver.

15. A vehicle straightening jig comprising:
(a) an elongated longitudinal spine member having first and second opposite ends, said first end including an end receiver;
(b) a center joint coupled with said spine, said center joint including a pair of intermediate receivers;
(c) a plurality of support legs extending from said spine member to support said jig on a support surface;
(d) a frame connection device positioned on at least one of said legs to connect said jig to a vehicle frame;
(e) a spider joint positioned at said first end of said spine member, said spider joint including five evenly spaced spider receivers in fixed radiating relation; and
(f) each of said receivers adapted to enable selective connection of a pulling assembly to said receiver for exerting a pulling force against said vehicle from eight discrete locations.

16. A jig as set forth in claim 15, including:

(a) a carriage assembly having ground engaging wheels.

17. A jig as set forth in claim 15, wherein:

(a) said support legs are pivotally coupled with said spine member to enable selective lateral angular adjustment of said legs on said support surface and selective positioning of said legs to connect to a vehicle frame or body to be straightened.

18. A jig as set forth in claim 15, wherein:

(a) said support legs are pivotable to a folded position generally parallel and adjacent to said spine member.

19. A jig as set forth in claim 15, including:

(a) pivot plates connecting said support legs to said spine to enable pivoting and fixing said legs in a selected angular orientation with respect to said spine member.

20. A jig as set forth in claim 15, including:

(a) said frame connection device being adjustably connected with said leg for connecting said jig to a variety of vehicles.

21. A jig as set forth in claim 15, including:

(a) said intermediate receivers of said center joint each independently translatable along said spine.

22. A jig as set forth in claim 15, including:

(a) said spider joint receivers radiating within an arc of 180°.

23. A portable vehicle straightening jig comprising:

(a) an elongated longitudinal spine member having first and second opposite ends;

(b) said first and second ends including a carriage assembly having ground engaging casters;

(c) a plurality of support legs extending from said spine member to support said jig on a support surface;

(d) pivot plates connecting said support legs to said spine member to enable pivoting and fixing said legs in a selected angular orientation with respect to said spine member;

(e) said pivot plates enabling pivoting of said support legs to a folded position generally parallel and adjacent to said spine member;

(f) a frame connection device adjustably connected to each one of said legs to connect said jig to a vehicle frame;

(g) a pair of center joints, each independently translatable along said spine, said joints each including an intermediate receiver adapted to enable selective connection of a pulling assembly to said intermediate receiver;

(h) a spider joint positioned at said first end of said spine member, said spider joint including five evenly spaced receivers in fixed radiating relation within an arc of 180°, each receiver adapted to enable selective connection of a pulling assembly to said receiver; and (i) said second end of said spine member including an end receiver adapted to enable selective connection of a pulling assembly or a handle to said end receiver.

* * * * *